US008322089B2

(12) United States Patent
Railkar et al.

(10) Patent No.: US 8,322,089 B2
(45) Date of Patent: Dec. 4, 2012

(54) HIDDEN RIDGE VENT FOR SLATE ROOFS

(75) Inventors: Sudhir Railkar, Wayne, NJ (US); Adem Chich, Kearney, NJ (US); Walter Zarate, Prospect Place, NJ (US); Jeffrey Avitabile, Lodi, NJ (US); Breck Hudson, Gainesville, GA (US); Tim Manasterski, Cumming, GA (US)

(73) Assignee: Building Materials Investment Corporation, Wilmington, DE (US)

( * ) Notice: Subject to any disclaimer, the term of this patent is extended or adjusted under 35 U.S.C. 154(b) by 40 days.

(21) Appl. No.: 12/908,219

(22) Filed: Oct. 20, 2010

(65) Prior Publication Data

US 2012/0096782 A1 Apr. 26, 2012

(51) Int. Cl.
*E04B 7/00* (2006.01)

(52) U.S. Cl. ..... 52/198; 52/95; 454/364; 454/365; 454/366

(58) Field of Classification Search ..... 52/198, 52/199, 302.1, 94, 95; 454/364, 365, 366, 454/260; D23/373, 393, 370, 371, 387, 391; D25/119, 164, 141, 55
See application file for complete search history.

(56) References Cited

U.S. PATENT DOCUMENTS 4,907,499 A * 3/1990 James ..... 454/365
4,957,037 A * 9/1990 Tubbesing et al. ..... 454/366
5,070,771 A * 12/1991 Mankowski ..... 454/275
5,095,810 A * 3/1992 Robinson ..... 454/365
5,122,095 A * 6/1992 Wolfert ..... 454/365
5,457,920 A * 10/1995 Waltz ..... 52/199
5,458,538 A * 10/1995 MacLeod et al. ..... 454/365
5,535,558 A * 7/1996 Rieke et al. ..... 52/199
5,772,502 A * 6/1998 Smith ..... 454/365
6,128,869 A * 10/2000 Brotherton et al. ..... 52/198
6,227,963 B1 * 5/2001 Headrick ..... 454/365
6,233,887 B1 * 5/2001 Smith ..... 52/199
6,260,315 B1 * 7/2001 Smith ..... 52/199
6,277,024 B1 * 8/2001 Coulton ..... 454/365
6,308,472 B1 * 10/2001 Coulton et al. ..... 52/198
6,684,581 B2 * 2/2004 Robinson et al. ..... 52/198
6,793,574 B1 * 9/2004 Robinson ..... 454/365
6,991,535 B2 * 1/2006 Ciepliski et al. ..... 454/365
7,537,518 B2 * 5/2009 Villela et al. ..... 454/365
(Continued)

*Primary Examiner* — Robert J Canfield
*Assistant Examiner* — Babajide Demuren
(74) *Attorney, Agent, or Firm* — Womble Carlyle Sandridge & Rice, LLP

(57) ABSTRACT

A ridge ventilation system includes a plurality of ridge vent sections configured to be arranged end-to-end along the ridge of a roof covering a vent slot formed therealong. Each ridge vent section has an elongated longitudinally flexible top panel with a central portion, edge portions terminating at extreme edges of the top panel, and ventilation grids extending beneath and along the edge portions spaced from extreme edges thereof. The space between the extreme edges of the top panel and the ventilation grids forms or defines an overhang configured to receive edges of shingles in a course of shingles installed next to the vent section and to inhibit the edges of the shingles from rising up. The ridge vent sections also have depending deflectors for deflecting blowing rain and snow that might enter through the ventilation grids and filter fabric may be affixed to the bottom of the ridge vent sections to provide additional deflection of rain and snow. The ridge ventilation system is particularly useful with slate or slate-style roofs and the vent sections are sized so that ridge cap slates extend beyond the extreme edges of the sections to hide substantially the ridge ventilation system from view.

28 Claims, 6 Drawing Sheets

U.S. PATENT DOCUMENTS 7,662,037 B2 * 2/2010 Polston ..... 454/365
7,814,715 B2 * 10/2010 Coulton et al. ..... 52/198
2009/0130969 A1 * 5/2009 Grisham et al. ..... 454/260
2010/0112932 A1 * 5/2010 Grubka et al. ..... 454/365

* cited by examiner

HIDDEN RIDGE VENT FOR SLATE ROOFS

TECHNICAL FIELD

This disclosure relates generally to roofs and roofing and more specifically to ridge ventilation suitable for use with slate or slate-style roofs.

BACKGROUND

Slate roofing shingles, be they natural slate or artificial slate (slate-style), are desirable because of their beauty and durability among other things. Providing ventilation of attic space below a slate roof can, however, be a challenge for a variety of reasons. Ridge ventilation systems using ridge vents installed along ridges of a roof have become popular in general for ventilating attic spaces. While ridge ventilation systems are common for roofs covered with traditional shingles, applying them to the ridges of slate or slate-style roofs presents unique problems. For example, many slate roofs are steeply pitched making their ridges rather sharp compared to traditional roofs so that bending a ridge vent across the ridge can be problematic. Further, traditional ridge vents may have visible ventilation grids and baffles that project from beneath ridge cap shingles applied to the top of the ridge vent. It can, however, be considered unsightly by some to have ventilation grids exposed on a slate roof, and can be otherwise generally undesirable. Finally, many slate and slate-style roofs have ridge beams that extend along the ridge of the roof and these ridge beams can interfere with the installation and function of a ridge ventilations system. A need exists for a ridge ventilation system for use with slate or slate-style roofs that, among other things, will accommodate highly pitched roof ridges; that, when covered with ridge cap slates, is substantially hidden and does not have exposed ventilation grids; that will inhibit ingress of rain and snow; and that will accommodate roofs with ridge boards extending along the roof ridge. It is to the provision of such a ridge vent that the present disclosure is primarily directed.

SUMMARY

Briefly described, a ridge ventilation system for slate and slate-style roofs comprises a plurality of elongated ridge vents configured to be installed end-to-end along the roof ridge covering a ventilation slot formed along the ridge. Each ridge vent has an elongated flexible top panel with opposed edges. At least two relief lines, i.e. lines of relative weakness, are formed along the central portion of the top panel of each ridge vent and the top panel bends along these lines when installed along the roof ridge to accommodate the pitch of the roof. This allows the ridge vent to conform to steep roof pitches and helps to maintain the rather sharp peaked appearance of the ridge when ridge cap slates are installed atop the ridge vents. It further accommodates attics with ridge board construction. An array of support baffles project downwardly from the top panel and rest upon the roof deck on either side of the ventilation slot when the ridge vent is installed. These support baffles hold the top panel above the roof deck to form a ventilation path. Hot attic air flows by convection through the ventilation slot in the roof ridge, beneath the top panel of the ridge vent, and exits from beneath the edges of the ridge vents to be exhausted to the atmosphere. The width of the ridge vent sections is predetermined so that ridge cap slates installed along the top of the ridge vent extend beyond the extreme edges of the top panel so that the entire ridge ventilation system is hidden beneath the ridge cap slates.

A ventilation grid is formed beneath the edge portions of the top panel of each ridge vent to prevent ingress of insects and debris beneath top panel and into the attic. The ventilation grid preferably is spaced inwardly from the extreme edges of the top panel to define an overhang. The support baffles extend laterally beneath the overhang and are curved inwardly and downwardly to form hold-downs. With this configuration, the upper edges of field slates installed along the ridge vents can be slipped beneath the overhang to engage or reside adjacent the curved ends of the support baffles. The support baffles, then, hold the upper edges of the field slates down and help prevent them from lifting up off of the roof deck.

To inhibit ingress of rain and snow into the attic below, a plurality of staggered deflectors depend from the underside of the top panel toward the roof deck. The standoffs, which can be flat or curved toward the edges of the top panel, are positioned and arranged so that together they present a substantially continuous barrier in the lateral direction against blowing rain and snow. In the longitudinal direction, however, they are staggered to maintain a predetermined net free ventilation area (NFA) of the ridge vent. A sheet of filter media may be installed on the bottom of the ridge vent in the ventilation path. The filter media allows air to flow from the attic below but further inhibits snow and rain from blowing into the ridge slot beneath the central portion of the ridge vent.

These and other features, aspects, and advantages of the ridge ventilation system and ridge vents disclosed herein will be better appreciated upon review of the detailed description set forth below when taken in conjunction with the accompanying drawing figures, which are briefly described as follows.

DETAILED DESCRIPTION

Figure 1:
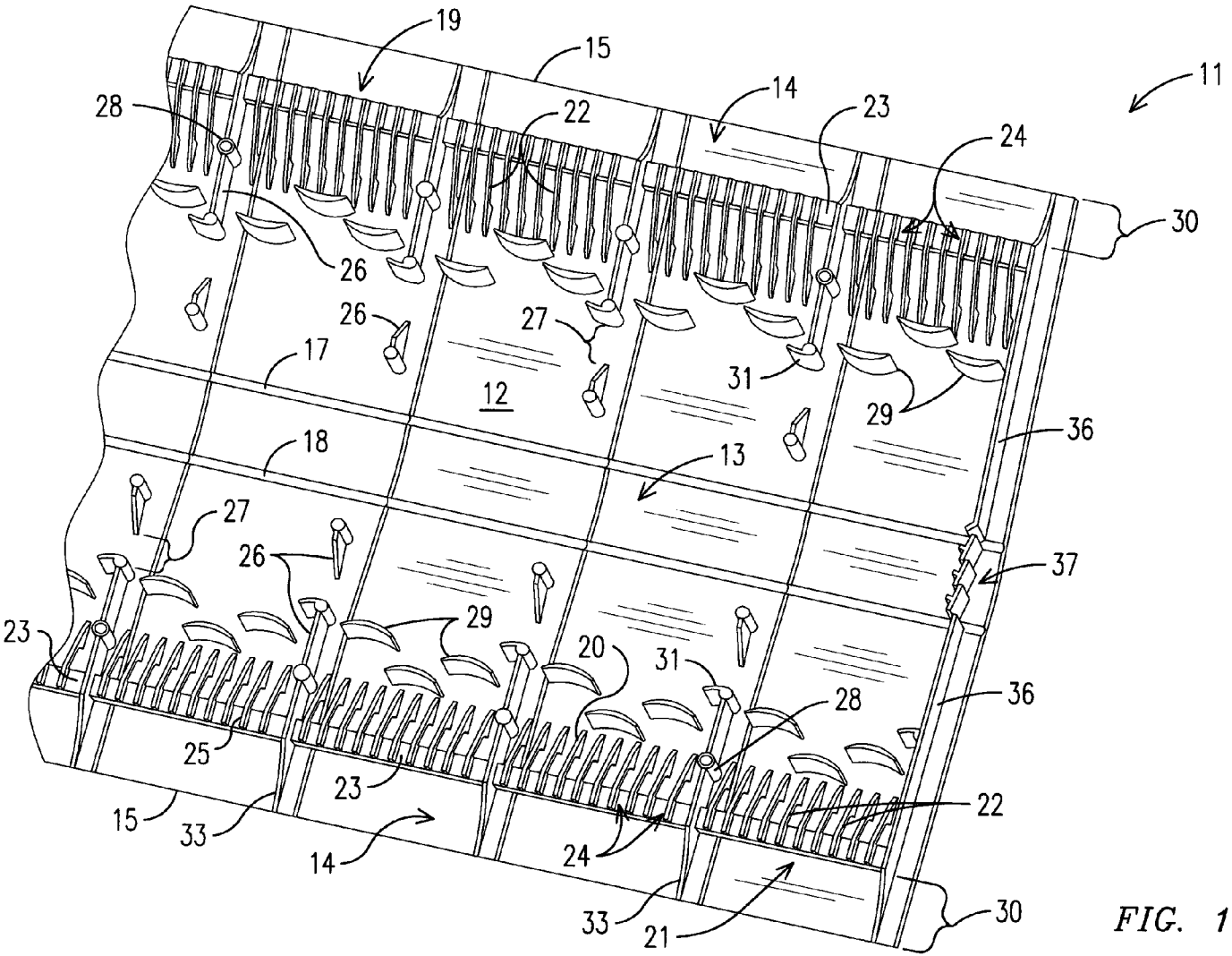
FIG. 1 is a perspective view of the underside of a ridge vent according to one embodiment of the disclosure illustrating various features of the vent.

Referring now in more detail to the drawing figures, wherein like reference numerals indicate like parts throughout the several views, FIG. 1 illustrates a portion of a ridge vent section according to the disclosure as seen from the bottom side thereof; that is, the side that faces to roof ridge when installed. A ridge ventilation system is formed by arranging a plurality of such ridge vent sections end-to-end along a roof ridge covering the ventilation slot thereof. This description will refer primarily to the features of a single ridge vent section, but it will be understood that the description applies to like ridge vent sections that form the ventilation system. The term "upwardly" as used herein refers to a direction toward the top panel of the ridge vent section and "downwardly" refers to a direction away from the top panel.

In FIG. 1, the ridge vent 11, which preferably is unitarily formed of injection molded plastic, has a laterally flexible top panel 12 with a central portion 13 and edge portions 14 that terminate at extreme edges 15. A pair of spaced apart relief lines 17 and 18 is formed within the central portion 13 of the top panel 12 and extends therealong. The relief lines comprise lines of relative weakness as compared to the surrounding material of the top panel 12 and, in the illustrated embodiment, are formed as elongated depressions in the bottom surface of the top panel, although other configurations are possible.

A first ventilation grid 19 extends along and beneath one edge portion 14 of the top panel spaced from its extreme edge 15 and a second ventilation grid 21 extends along and beneath the opposite edge portion 14 spaced from its extreme edge 15. Each ventilation grid comprises an array of spaced apart louvers 22 that forms a grill for allowing air flow while preventing ingress of insects and debris beneath the top panel 12. Each louver extends from an upper end 20 attached to the top panel 12 downwardly and outwardly at an angle to a lower end 25 attached to a longitudinally extending support strip 23. The lower ends 25 of the louvers 22 project slightly downwardly and away from the surface of the support strip 23, as indicated at 24, forming a serrated or corrugated configuration along the underside of the support strip. When the ridge vent 11 is installed along the ridge of a roof, the projecting lower ends 25 of the louvers hold the support strip 23 slightly above the roof deck forming a passage through which water can flow out from beneath the ridge vent.

The edges of the top panel 12 that project beyond the ventilation grids 19 and 21 forming overhangs 30. Spaced apart supports baffles 26 project downwardly from the top panel 12 and extend laterally from inside the ventilation grids 19 and 21 to curved exterior ends 33 disposed outside the ventilation grids and beneath the overhangs 30. The ends 33 curve outwardly and upwardly from the support strips 23 to the extreme outer edges 15 of the top panel 12 for purposes described in more detail below. Nail bosses 28 having central holes that extend through the top panel are formed in at least some of the support baffles 26 for receiving nails used to secure the ridge vent 11 to a roof deck during installation. A gap or slot 27 preferably is cut or formed along the length of each support baffle for receiving a portion of a sheet of filter fabric 51 (FIG. 7) as described in more detail below.

An array of deflectors 29 is located between each support baffle inside the ventilation grids and each deflector extends downwardly from the top panel 12 to a lower end substantially aligned with the lower edges of the support baffles 26. In the embodiment of FIG. 1, the deflectors 29 are formed with an arcuate cross-section that is concave on the sides of the deflectors facing the ventilation grids 19 and 21. Other configurations of the deflectors are possible as discussed below. Preferably, the deflectors 29 are positioned such that their projections overlap slightly in the transverse direction to present a substantially continuous barrier to blowing snow or rain that might enter through the ventilation grids 21. However, they are spaced apart in the longitudinal and lateral directions and positioned in such a way that the net free area (NFA) of the ridge vent is preserved. In other words, air can flow freely around and through the deflectors but incoming rain or snow likely will encounter a deflector and be stopped. Deflector tails 31 may formed on one or both sides of the support baffles 26 to help complete the continuity of the barrier formed by the deflectors. The shapes and positioning of the deflectors is discussed in more detail below relative to FIG. 6.

The top panel 12 extends slightly beyond the end wall 36 to define an overhang at the end of each vent panel. While not specifically illustrated in the figures, the opposite end of each vent panel is formed with a matching step that underlies the overhang when two vent sections are aligned end-to-end. The step is further formed with a groove or channel that captures any water that might seep between the ends of two aligned ridge vent panels and directs the water toward the edges of the panels, where it is shed onto the roof. This prevents any seepage of water through the ridge cap shingles from entering the attic below. This arrangement may be referred to as male-female end caps on each vent section.

Figure 2:
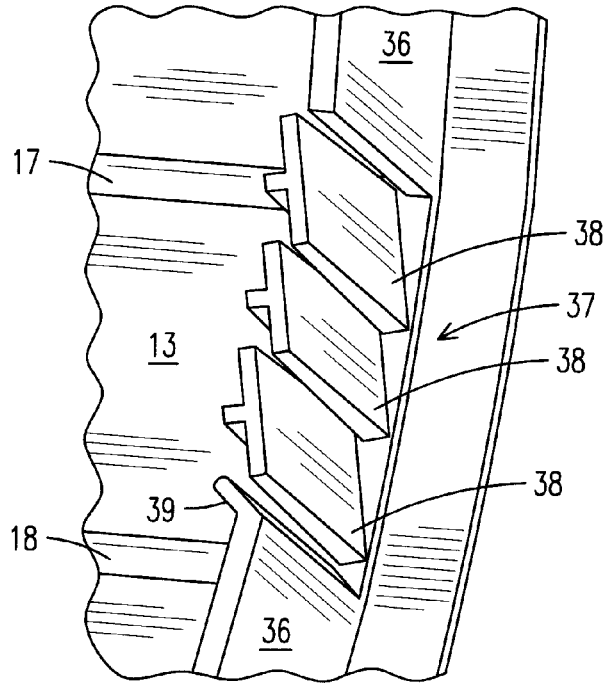
FIG. 2 is an enlarged perspective of an end of the ridge vent illustrating the overlapping baffles that prevent ingress of water and debris from the ends of the ridge vent.

The ridge vent 11 in this embodiment is a section that might, for example, be approximately four feet long. To complete a ridge vent along a roof ridge, several sections are joined together end-to-end to form a completed ridge ventilation system that spans the length of the ventilation slot formed along the roof ridge. The vent sections at the ends of the run thus have their ends exposed, and it is required to prevent ingress of weather and debris through these exposed ends. For this purpose, and with continuing reference to FIG. 1, an end wall 36 is formed at the ends, or at least one end, of each of the ridge vent sections. The end wall 36 projects downwardly from the top panel 12 to rest on a roof deck when the section is installed along a roof ridge. Relief baffles 37 are formed in the center portion of the end wall 36 substantially aligned with the relief lines 17 and 18 to accommodate bending of the ridge vent section to conform to the roof pitch. FIG. 2 illustrates better the configuration of the relief baffles. Each relief baffle 37 is made up of a plurality of baffle sections 38. While three baffle sections are shown in FIG. 2, it will be understood that more than three baffle sections might be formed in the end wall 36 to accommodate tighter bends of the ridge vent section. At any rate, each baffle section 38 is angled with respect to the plane of the end wall 36 so that when the ridge vent is bent for installation along a roof ridge, the baffle sections progressively interleave with one another to accommodate the bend. This allows the ridge vent to bend easily along its mid-section while forming a barrier against weather, insects, and debris completely across any exposed ends of ridge vent sections. Preferably, a dog leg 39 is formed in the end wall 36 on at least one end of the relief baffle 37 to prevent ingress at this location when the ridge vent section is bent. More specifically, when the section is bent along its central portion 13, the end baffle section 38 engages the dog leg 39 to close the gap between the end baffle section and the end wall 36. FIG. 2 also illustrates better one preferred embodiment of the relief lines 17 and 18 as being lines of indentation formed along the central portion 13 of the ridge vent section. The indentations form lines of relative weakness along which the top panel bends or folds when installed.

Figure 3:
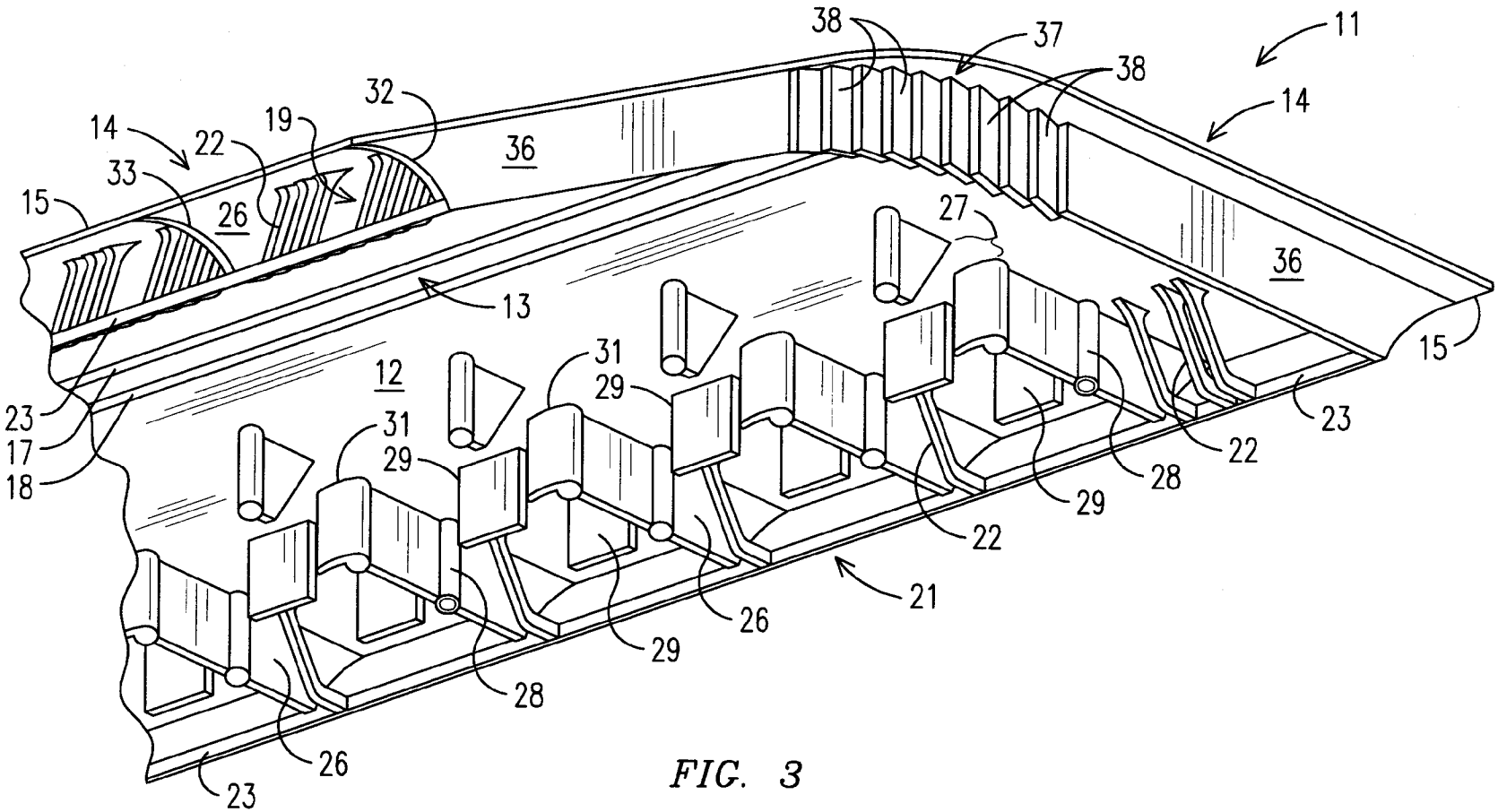
FIG. 3 is a perspective view of a portion of the ridge vent of this embodiment illustrating the overhang and curved support baffle ends for receiving and holding down top edges of field slates.

FIG. 3 is a perspective view of a ridge vent section according to one embodiment shown in its upright orientation with its bottom side facing downward. As described, the vent section has a top panel 12 with a central portion 13 and edge portions 14. Relief lines 17 and 18 are formed along the central portion 13 and an end wall 36 with a central relief baffle 37 is formed at the end of the vent section. In this embodiment, several of baffle sections 38 are provided rather than the three of FIG. 2. The vent sections 19 and 21 comprise spaced apart louvers 22 that extend downwardly and outwardly from the top panel 12 to the support strip 23. Support baffles 26 extend from the interior side of the vent sections and through the vent sections to the extreme edges 15 of the top panel 12. The ends 33 of the support baffles as well as the ends 32 of the end wall 36 are curved outwardly and upwardly from the support strip 23 to the extreme edges 15 of the top panel 12 forming a stop or hold-down for the uppermost course of field shingles of the roof, as described in more detail below.

Figure 7:
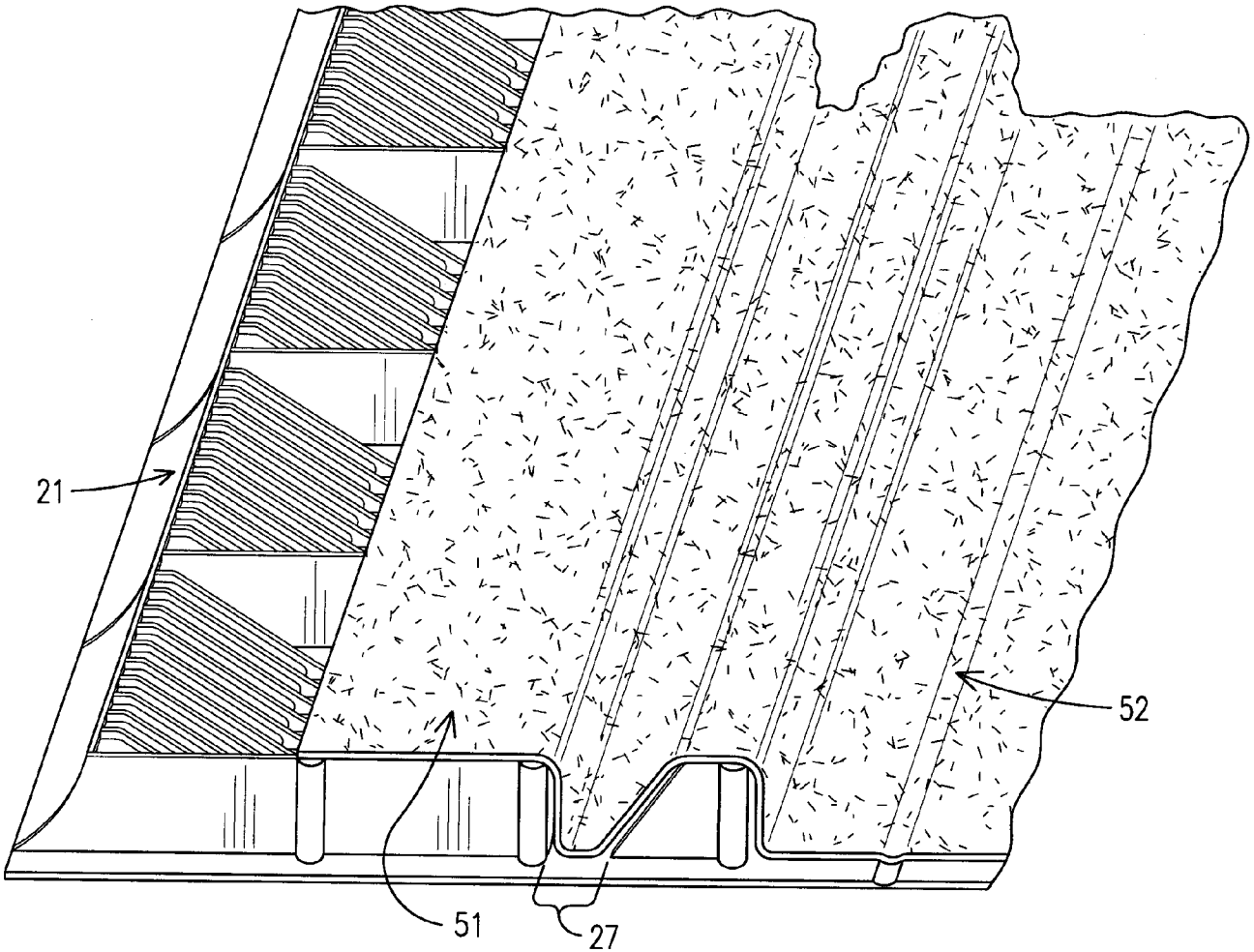
FIG. 7 is a perspective view from the underside of the ridge vent illustrating one possible placement of filter fabric for inhibiting further the ingress of rain and snow.

Tails 31 are formed on an interior portion of the support baffles and depending deflectors 29 are strategically positioned between the support baffles 26. In the embodiment of FIG. 3, the deflectors are substantially flat in cross section rather than curved as illustrated in FIG. 1. As discussed below, the deflectors may be formed in a variety of shapes and configurations according to application specific requirements. Slots 27 are formed in the support baffles for receiving filter fabric 51 (FIG. 7). Nail bosses 28 are formed in at least some of the support baffles 26 for attaching the ridge vent section to a roof deck with nails or other fasteners. The nail bosses are located to align with the roof deck on either side of a ridge slot so that the fasteners engage the roof deck material to secure the ridge vent section to the roof rather than extending into the ridge slot. It will be apparent from FIG. 3 that the ridge vent section can be bent or folded along its central portion 13, facilitated by the relief lines 17 and 18, to conform to the pitch of a roof ridge and that, in doing so, the relief baffles bunch together and interleave to form a barrier at the end of the ridge vent section. The section is then attached to the roof deck with nails driven through the nail bosses 28 and into the roof deck material. Like ridge vent sections can then be affixed in a similar way in an end-to-end fashion.

Figure 4:
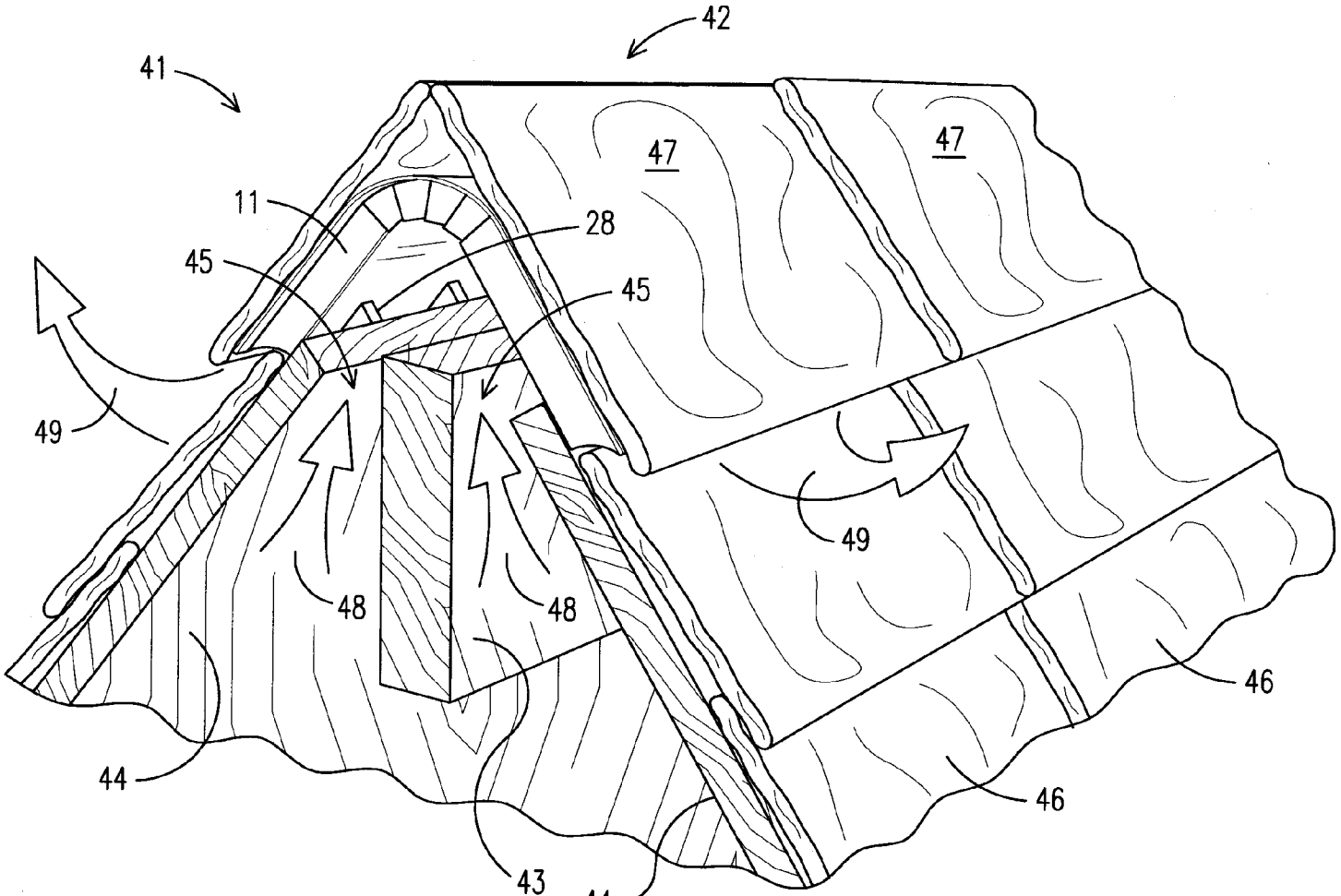
FIG. 4 is a perspective view of a ridge vent according to the disclosure installed along the ridge of a slate-shingled roof and covered with ridge cap slates.

FIG. 4 illustrates in cross section a ridge vent of this disclosure installed along the ridge of a slate-shingled roof and covered with ridge cap slates. The roof 41 has a ridge 42 and a roof deck 44 supported by rafters (not visible) extends downwardly at angles from a ridge beam 43. The roof 41 shown in FIG. 4 is rather severely pitched, which is a common architecture for roofs that are shingled with slate. A ridge slot 45 is formed along the ridge of the roof on either side of the ridge beam. Ridge vent 11 according to this disclosure is installed along the ridge of the roof spanning the ridge slot 45. More specifically, the ridge vent is bent along it central portion aided by the double relief lines 17 and 18 until it comes into contact with the roof deck on either side of the ridge slot. Nails are then driven through the nail bosses 28 and into the roof deck along the length of the ridge vent to secure the ridge vent in place. With the ridge vent covering the ridge slot, hot attic air 48 can flow by convection upwardly through the ridge slot and then laterally beneath the top panel of the ride vent to be exhausted through the ventilations grids along the edge portions of the ridge vent, as indicated by flow arrows 49.

With the ridge vent thus installed, the roof can be shingled with slate or slate-style shingles. More specifically, courses of field slates 46 can be installed in a known manner on the roof deck and ridge cap slates 47 can be installed covering the ridge vent 11 as illustrated. Significantly, the upper-most course of field slates are installed with the top edges of the slates disposed beneath the overhang 30 (FIG. 1) along the edges of the ridge vent 11. As detailed below, the curved outer ends 33 (FIG. 3) of the support baffles 26 function to space the upper edges of the field slates from the ventilation grids 19 and 21 of the ridge vent 11 to maintain a predetermined NFA of the vent, which might, for example, be 18 square inches per foot of vent. Furthermore, the curved ends of the support baffles form hold-downs that prevent the top edges of the upper-most field slates from rising up unintentionally above the roof deck. As seen in FIG. 4, the ridge vent 11 is sized such that ridge cap slates 47 extend beyond the extreme outer edges of the ridge vent. In this way, the ridge vent is substantially hidden from view and therefore has a minimum impact on the architecture and appearance of the roof, which can be desirable.

Figure 5:
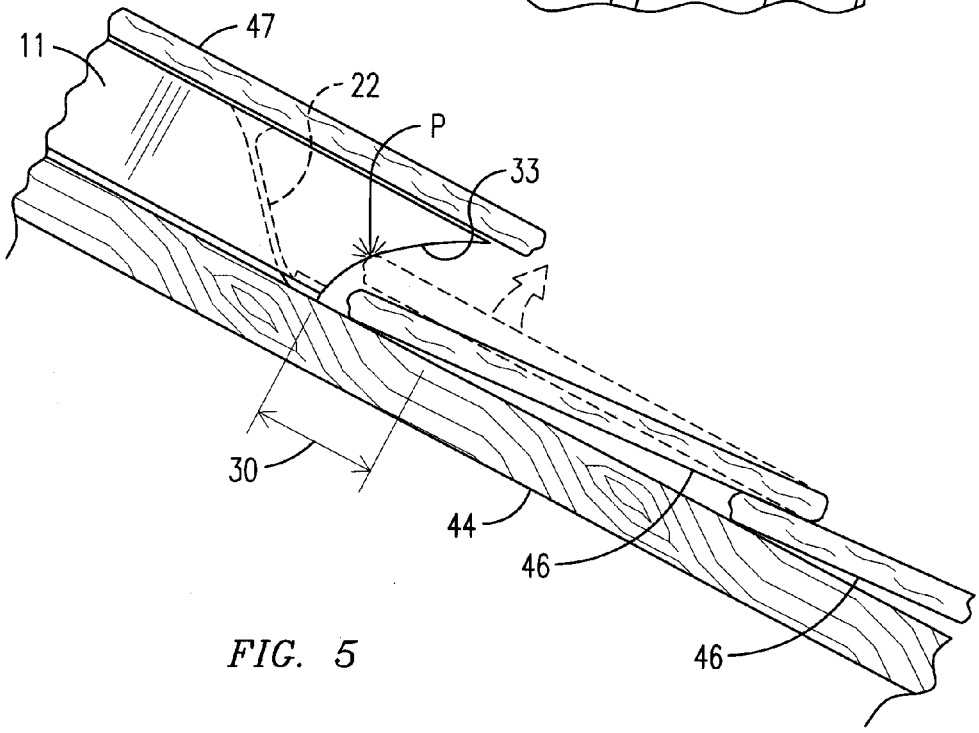
FIG. 5 is a cross-section illustrating how the top edges of field slates installed along the ridge vent are held down by the ridge vent.

FIG. 5 illustrates perhaps better the function of the overhang and curved support baffle ends of the ridge vent 11. As discussed, the upper-most course of field slates 46 are installed with their top edges wedged or positioned beneath the overhang 30 along the edges of the ridge vent. The ends 33 of the support baffles curve outwardly as shown, whereas the louvers 22 of the ventilation grids extend upwardly and inwardly. Thus, even if the top course of field slates are butted against the bottoms of the curved ends 33 of the support baffles, they do not interfere with or block air flow through the ventilation grids. Accordingly, the NFA of the ridge vent is maintained. Furthermore, if the upper course of field slates, which do not have the weight of another slate resting on their top edges, should tend to raise up due to high winds or otherwise (as illustrated in phantom lines), the upper edge of the slates impacts the curved outer ends of the support baffles at, for example, point P. This prevents the upper course of slates from rising up. The overhang 30 and curved ends 33 of the support baffles thus double as a hold-down feature to help maintain the upper course of slate shingles in place.

Figure 6:
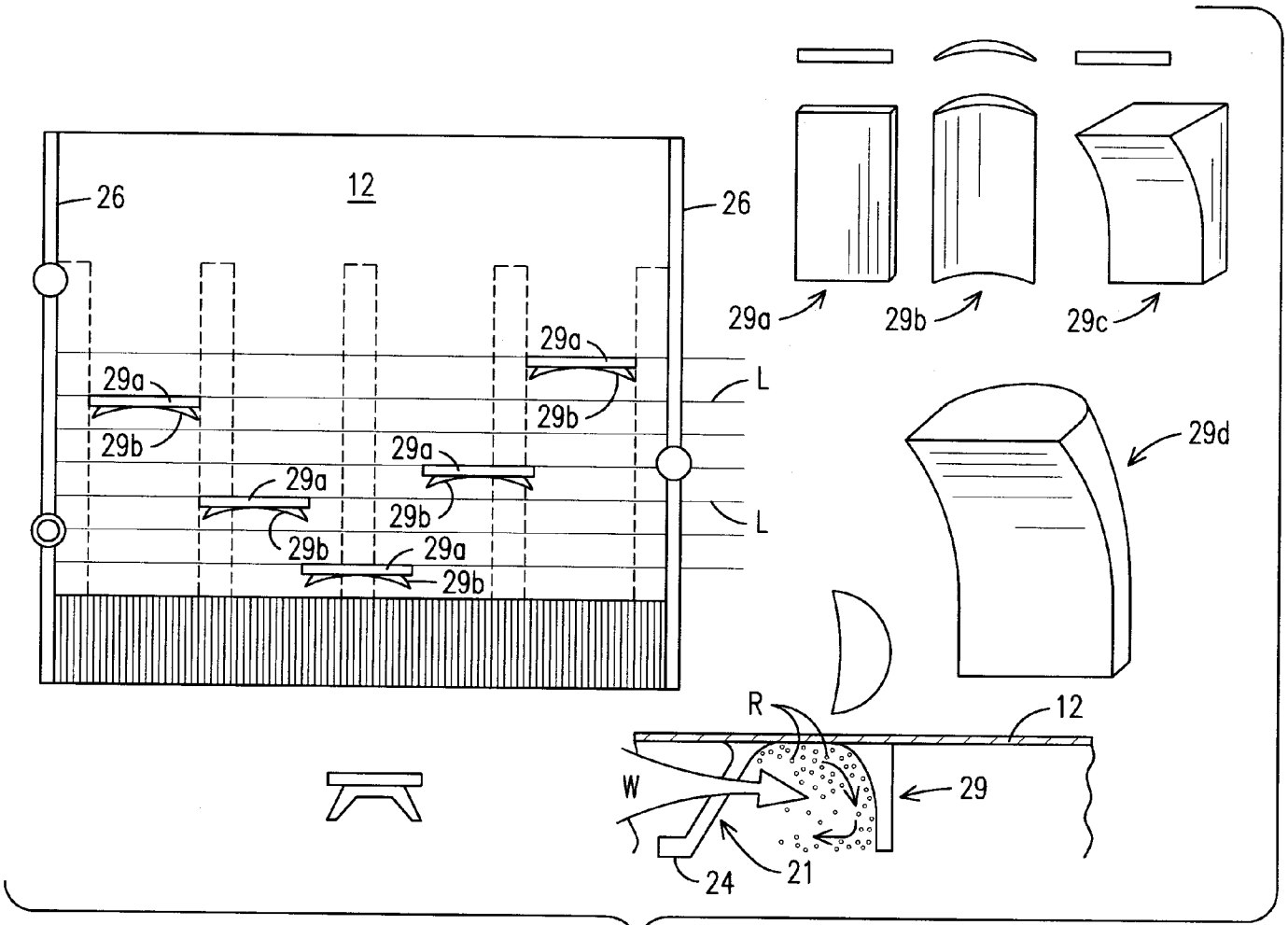
FIG. 6 illustrates various embodiments of deflector configurations for inhibiting ingress of wind, snow, and debris into an attic space.

FIG. 6 illustrates, without limitation, the various shapes of deflectors 29 that may be used to inhibit blowing rain from entering the attic space through the ridge slot. As discussed above and as shown on the left in FIG. 6, the deflectors depend from the top panel 12 and are positioned between support baffles 26 so that their edges overlap slightly in the lateral direction. The deflectors thus present a substantially continuous barrier in the lateral direction against the ingress of blowing rain and snow entering through the ventilation grids. However, each deflector is spaced laterally from adjacent deflectors and, preferably, no two deflectors between a pair of support baffles lie along the same longitudinal line L. The spacings of the deflectors, both laterally and longitudinally, are selected so that a desired NFA of the ridge such as, for instance, 18 square inches per foot, is maintained. Air may flow freely through and around the deflectors and out of the vent while incoming rain and snow is likely to impact and be deflected by a deflector.

The deflectors 29 may take on any of a variety of shapes and configurations to intercept and deflect blowing rain or snow that might enter through the ventilation grids. Some examples are presented on the right side of FIG. 6. Deflector 29*a*, for instance, is formed with a simple rectangular cross section along its length. It is this configuration of deflector that is depicted in FIG. 3. As another example, deflector 29*b* has an arcuate cross section with its concave side facing the ventilation grids of the ridge vent. Such a configuration presents relatively higher resistance to wind entering the ridge vent through the ventilation grids and relatively lower resistance to air exhausting out through the ventilation grids and may provide better deflection of blowing rain and snow. Deflector 29*c* has a cross section that tapers gradually from a wider base at the top panel of the ridge vent to a narrower bottom end. Such a configuration may tend to deflect blowing rain and snow entering the ventilation grids downwardly toward the roof deck and thereby lessen the chances that it can navigate past the deflectors and into a ridge slot beyond. Another alternate configuration 29*d* is a combination of 29*b* and 29*c* and has an arcuate cross section and also tapers from a wider base to a narrower end. This configuration may provide the benefits of both configurations 29*b* and 29*c*. The lower portion of FIG. 6 illustrates in general the function of deflectors 29 to help deflect blowing rain and snow away from a ridge slot over which a ridge vent is installed. The deflectors 29 are positioned inside the ventilation grids 21. A blowing wind W may carry rain droplets R or snow flakes through the ventilation grid 21 toward the central portion of the ridge vent and the ridge slot below. However, the deflectors 29 tend to intercept the rain droplets R, which flow down the deflectors to the roof deck below, where they are shed away down the roof. The corrugations 24 (FIG. 1) form pathways through which the deflected water can flow from beneath the ridge vent.

In some cases, such as, for instance, in regions with severe winters, additional protection may be needed against ingress of blowing rain and snow. In such cases, it may be desirable to apply a sheet of filter fabric to the bottoms of ridge vents to help intersect and deflect blowing rain and snow. Such an option is illustrated in FIG. 7 where a non-woven filter fabric 51 is applied to the underside of a ridge vent. The filter fabric may be heat staked in place at strategic locations such as along line 52. Preferably, the fabric is draped into and secured with the slots 27 (FIG. 1) formed in the support baffles and heat staked or otherwise secured therealong. Such a configuration provides three layers of filter fabric between the ventilation grids 21 and a ridge slot over which the ridge vent is installed. The multiple crisscrossing fibers of the filter fabric tend to engage and arrest water droplets and snowflakes that may blow through the ridge vents and prevent them from progressing to a ridge slot and into an attic below.

The invention has been described in terms of preferred embodiments and methodologies considered by the inventors to represent the best mode or modes of carrying out the invention. However, these exemplary embodiments are not intended to limit the invention but rather only to illustrate particular configurations within the invention. A wide variety of additions, deletions, and modifications might well be made to the illustrated embodiments without departing from the spirit and scope of the invention, which is delineated only by the claims.

What is claimed is:

1. A ridge vent section suitable for slate shingled roofs, the ridge vent comprising:

an elongated laterally flexible top panel having an upper side, a lower side, a central portion, and edge portions terminating at extreme edges of the top panel;

ventilation grids depending from the lower side of the top panel with each ventilation grid extending along a respective edge portion of the laterally flexible top panel spaced from the extreme edge thereof;

the edge portions of the top panel defining an overhang between the ventilation grids and an extreme edge of the edge portions;

an array of longitudinally spaced apart support baffles each depending from the lower side of laterally flexible top panel and extending laterally beneath the overhang from the ventilation grids to an extreme edge of the edge portions, the baffles being arched from a lower edge of each ventilation grid toward an extreme edge of the edge portion of the top panel to form a series of spaced apart hold-downs for a row of field shingles installed beside the ridge vent; and the top panel being sized to be substantially hidden beneath ridge cap shingles installed atop the ridge vent when the ridge vent is applied along the ridge of a roof.

2. A ridge vent section as claimed in claim 1 and further comprising at least one line of relative weakness formed along the central portion of the top panel.

3. A ridge vent section as claimed in claim 2 and wherein two spaced apart lines of relative weakness are formed along the central portion of the top panel.

4. A ridge vent section as claimed in claim 3 and wherein the lines of relative weakness comprise lines of indentation formed in the central portion of the top panel.

5. A ridge vent section as claimed in claim 4 and wherein the lines of indentation are formed on the lower side of the top panel.

6. A ridge vent section as claimed in claim 1 and wherein the ventilation grids depend downwardly at an angle relative to the lower side of the top panel.

7. A ridge vent section as claimed in claim 6 and wherein the ventilation grids extend downwardly from the lower side of the top panel and outwardly relative to the central portion of the top panel.

8. A ridge vent section as claimed in claim 1 and further comprising deflectors depending from the lower side of the top panel and being arranged to intercept and deflect blowing rain and snow that may enter through the ventilation grids.

9. A ridge vent section as claimed in claim 8 and wherein the deflectors are spaced apart in the lateral direction and staggered with respect to one another.

10. A ridge vent section as claimed in claim 9 and wherein the deflectors are sized such that they partially overlap one another in the lateral direction to present a substantially continuous barrier.

11. A ridge vent section as claimed in claim 8 and wherein the deflectors are substantially rectangular in cross section.

12. A ridge vent section as claimed in claim 8 and wherein the deflectors are substantially curved in cross section to define a concave surface facing the ventilation grids.

13. A ridge vent section as claimed in claim 8 and wherein the deflectors taper from a wider portion at the top panel to a narrower portion at free ends of the deflectors.

14. A ridge vent section as claimed in claim 13 and wherein the deflectors are further curved to present a concave surface toward the ventilation grids.

15. A ridge vent section as claimed in claim 1 and wherein the ventilation grids have insides facing the central portion of the top panel and wherein the support baffles also extend toward the central portion of the top panel on the insides of the ventilation grids.

16. A ridge vent section as claimed in claim 15 and further comprising a slot formed in the support baffles on the insides of the ventilation grids, the slots of the support baffles being substantially aligned in the longitudinal direction of the ridge vent section.

17. A ridge vent section as claimed in claim 16 and further comprising filter fabric fixed to the underside of the ridge vent section, at least a portion of the filter fabric extending into the slots of the support baffles to form a double wall of filter fabric to inhibit ingress of rain and snow.

18. A ridge vent section as claimed in claim 17 and wherein the filter fabric is heat staked to the ridge vent section.

19. A ridge vent section as claimed in claim 17 and wherein the filter fabric is draped over internal ends of the support baffles to form another wall of filter fabric to inhibit ingress of rain and snow.

20. A roof comprising:

a roof deck;

a roof ridge;

a vent slot formed along the roof ridge;

a plurality of vent sections as claimed in claim 1 arranged end-to-end covering the vent slot;

courses of field shingles covering the roof deck, the shingles of the uppermost course of field shingles having upper edges disposed beneath the hold-downs formed by the arched ends of the support baffles; and ridge cap shingles covering the ridge vent sections.

21. The roof of claim 20 and wherein the ridge cap shingles extend beyond the extreme edges of the ridge vent.

22. The roof of claim 20 and wherein the shingles are slate-style shingles.

23. The roof of claim 20 and wherein the shingles are slate shingles.

24. A ridge ventilation system comprising a plurality of ridge vent sections configured to be arranged end-to-end along the ridge of a roof covering a vent slot formed therealong, each ridge vent section having an elongated laterally flexible top panel with a central portion, edge portions terminating at extreme edges of the top panel, and ventilation grids fixed to the top panel along a line spaced from an extreme edge of the top panel and extending downwardly and laterally outwardly therefrom, the space between the extreme edges of the top panel and the ventilation grids forming an overhang configured to receive edges of shingles in a course of shingles installed next to the vent section and to inhibit the edges of the shingles from rising up.

25. The ridge ventilation system of claim 24 and wherein the ventilation grids are angled downwardly and outwardly from the top panel to preserve a net free area of the ventilation grids when edges of shingles are disposed beneath the overhang.

26. The ridge ventilation system of claim 24 and wherein the top panels of the ridge vent sections are sized to receive ridge cap shingles with the ridge cap shingles projecting beyond the extreme edges of the top panel for substantially hiding the ridge ventilation system.

27. The ridge ventilation system of claim 24 and further comprising deflectors positioned to intercept and deflect rain and snow that might enter the ridge vent sections through their ventilation grids.

28. The ridge ventilation system of claim 27 and wherein the deflectors depend from the top panel on an interior side of the ventilation grids and are positioned to present a substantially continuous barrier toward the ventilation grids and are spaced in the lateral direction to permit airflow past the deflectors.

* * * * *